US007976675B2

(12) United States Patent
Turqueti

(10) Patent No.: US 7,976,675 B2
(45) Date of Patent: Jul. 12, 2011

(54) CONTINUOUS DIGESTER SYSTEM

(75) Inventor: Andre Turqueti, Curitiba (BR)

(73) Assignee: Metso Paper Sweden AB, Karlstad (SE)

( * ) Notice: Subject to any disclaimer, the term of this patent is extended or adjusted under 35 U.S.C. 154(b) by 0 days.

(21) Appl. No.: 12/954,927

(22) Filed: Nov. 29, 2010

(65) Prior Publication Data

US 2011/0067828 A1 Mar. 24, 2011

Related U.S. Application Data

(62) Division of application No. 12/198,915, filed on Aug. 27, 2008, now Pat. No. 7,867,363.

(51) Int. Cl.
*D21C 3/26* (2006.01)

(52) U.S. Cl. ..... 162/19; 162/237; 162/52; 162/68

(58) Field of Classification Search ..... 162/19, 162/52, 68, 237
See application file for complete search history.

(56) References Cited

U.S. PATENT DOCUMENTS

2005/0061458 A1* 3/2005 Snekkenes et al. ..... 162/19
* cited by examiner

*Primary Examiner* — Mark Halpern
(74) *Attorney, Agent, or Firm* — Rolf Fasth; Fasth Law Offices

(57) ABSTRACT

In a continuous digester system the digester system is greatly simplified by using a single vertical atmospheric vessel, replacing the conventional chip bin, steaming vessel, chip chute, high pressure pumping or sluice feeders, impregnation vessels and top separator. Chips are simply fed to the top of the atmospheric vessel, and a chip level is established in the vessel. Treatment liquids are added to the vessel such that a total liquid volume (Z1+Z2) with a liquid level (LIQ LEV) is established under the chip level (CH LEV). Impregnation stage and subsequent cooking stages are implemented in the atmospheric vessel at successively increasing temperature and depths into the total liquid volume, thus preventing boiling in the stages and preferably reducing steam blow trough of the chip surface in the top of the vessel.

11 Claims, 5 Drawing Sheets

CONTINUOUS DIGESTER SYSTEM

PRIOR APPLICATION

This is a U.S. Divisional patent application that claims priority from U.S. patent application Ser. No. 12/198,815, filed 27 Aug. 2008.

TECHNICAL FIELD

The present invention relates to a continuous digester system.

BACKGROUND AND SUMMARY OF THE INVENTION

In the pulping of comminuted cellulosic fibrous material, preferably but not excluded to wood chips, in a continuous digester the material is first treated to remove air bound in the cellulosic fibrous material. Typically, the cellulosic fibrous material is steamed to remove the material of air while simultaneously increasing the temperature to about 80-100° C. The steaming process will normally release the natural acidity of the wood material and the pH value in any drained steam condensate could easily reach 4-5. The steamed cellulosic fibrous material is thereafter slurried or impregnated in an impregnation or slurrying liquid with sufficient amount of chemicals, i.e. alkali and sulfidity in case of a kraft process.

The slurried cellulosic fibrous material is transported as slurry to the pressurized digester or impregnation vessel using high pressure pumps or a high pressure sluice feeder, and with a top separator arranged in the top of the pressurized impregnation vessel or in the top of the digester. The typical digester pressure is more than 5 bar (>0.5 MPa).

In conventional systems these steaming and slurrying systems have been installed as a system preceding the pressurized impregnation vessel or the pressurized digester vessel. The systems preceding the pressurized vessel have included expensive and energy consuming machines.

For a typical digester system, following systems and machines have been used;

Chip bins,

Steaming vessels

Slurrying chutes

High pressure sluice feeder and/or high pressure pumps

Impregnation vessels

Only to transport the slurried chips to the pressurized impregnation or digester vessel requires some 400 kW per ADT pulp produced. In a digester with a capacity of some 5000 ADT per day is thus required and a pumping system with an installed power available in the order of some 2 MW.

These systems and associated equipment and building structure are a large part of the total investment costs of a continuous digester system. Also, the operating costs of these systems and machines take a large part of the production costs for the pulp produced.

U.S. Pat. No. 3,303,088 disclosed already in mid 1960-ties a process using a single hydraulic digester, but with separate chip bin, steaming vessel, slurring tank and high pressure pumps ahead of the single hydraulic digester.

U.S. Pat. No. 5,635,025 disclosed an effort to patent the concept of a single vessel for the entire pre-treatment of chips, including the functions of a chip bin, a steaming vessel and the chip chute. This single pre-treatment vessel was located ahead of the transfer system including the high pressure sluice feeder. The corresponding Swedish application was abandoned as the concept with a common chip bin, steaming vessel and chip chute was anticipated by U.S. Pat. No. 3,532,594 from the mid 1960-ties.

A further improvement of the pre-treatment systems in a single impregnation vessel is disclosed in U.S. Pat. No. 7,381,302, where the impregnation vessel is held substantially at atmospheric pressure, and impregnation liquids at successively higher temperatures where added at successively increasing depth in the liquid volume established in the impregnation vessel. Still, the conventional high pressure sluice feeder was located after this impregnation vessel for feeding the impregnated chips to the pressurized digester. This type of atmospheric impregnation vessel, called the IMPBIN™ system guarantees that the chips are both steamed and impregnated at low temperature, resulting in easy cooking at low reject volumes and high pulp quality. The IMPBIN concept has been installed in a number of new digester systems throughout the world, in mills having capacities in the order of 3000-6000 ADT per day and has proven to be a success. One further advantage with the IMPBIN system is that this could be operated with "cold top" control, i.e. avoiding blow trough of steam, which reduce energy losses in gas handling systems needed as the amount of hot gases driven off from the chips and needing condensation is dramatically reduced.

The fait of the IMPBIN™ system has been challenged as the conventional approach has been using excessive steaming systems in chip bins and steaming vessels, and this excessive steaming has been perceived as a necessity in order to purge all air from chips and be able to establish a correct column movement of the chips in the digester.

However, excessive steaming in pre-treatment establish a high chip temperature and in subsequent impregnation stages is the cooking chemicals consumed as they penetrate the chips, preventing cooking chemicals from penetrating into the core of the chips and as a consequence causing high reject volumes.

The IMPBIN™ system has in spite of this proven to be fully sufficient in establishing the necessary impregnation of the chips and a smooth column movement inside the digester.

The present invention is related to a further improvement and simplification of the digester system, where both the installation costs, i.e. investment costs, and operating costs are dramatically reduced.

In view of the success of the IMPBIN™ system, this general impregnation concept could be integrated with the actual digester, and a true "single vessel" digester system would be obtained. By this integration are several major advantages obtained, such as;

No need to classify the digester vessel as a pressure vessel; and

Guaranteed low temperature impregnation, and

No power losses in chip transfer to a pressurized digester; and

No high pressure transfer systems, and

No expensive top separator mounted at the top of the digester; and

No need for chip bins, steaming vessels, and chip chutes etc.

In following parts are an atmospheric vessel referred to, and this implies a vessel not qualified as a pressure vessel and associated required testing and certification for a pressure vessel. According to European legislation a vessel must be classified as a pressure vessel if the pressure applied in the vessel is exceeding 0.5 bar. Thus, the atmospheric vessel could thus have a pressure established in the top substantially at atmospheric pressure, i.e. 0 bar (g), or a slight positive pressure of up to 0.5 bar (g) or slight negative pressure of down to −0.5 bar (g). The small deviation from a perfect atmospheric pressure is most often wanted for a controlled venting of the atmospheric phase in the top of the vessel as air may enter into the vessel with the raw material, i.e. chips, and a small leakage flow of malodorous gases could escape from the underlying chip volume. Preferably only an incremental positive pressure or negative pressure in the order of 0.1-0.2 bar is implemented, but still qualifying the vessel as an atmospheric vessel. The actual pressure established is controlled by the venting system, and parallel safety valves in form of reliable water-locks.

The establishment of a single vertically oriented atmospheric vessel enables a successive implementation of hotter treatment zones throughout the digester, and no need for a pressurized digester vessel is at hand, nor any separate pretreatment systems, nor any high pressure transfer devices. The principle applied is similar to that one shown for the impregnation vessel IMPBIN™ as shown in U.S. Pat. No. 7,381,302, but now applied to the entire cooking process. The possible temperature profiling throughout the vessel is given by following table;

| $T_{LIQ}$ (° C.) | Sat. P (kPa) | $\Delta H_{atm}$ (meter) | $\Delta H_{+0.5}$ (meter) | $\Delta H_{-0.5}$ (meter) |
|---|---|---|---|---|
| 105 | 120.8 | >2 | — | >7 |
| 110 | 143.3 | >4.3 | — | >9.3 |
| 115 | 169.1 | >6.9 | >1.9 | >11.9 |
| 120 | 198.5 | >9.8 | >4.8 | >14.8 |
| 125 | 232.1 | >13.2 | >8.2 | >18.2 |
| 130 | 270.1 | >17.0 | >12 | >23 |
| 135 | 313.0 | >23.3 | >18.3 | >28.3 |
| 140 | 361.3 | >26.1 | >21.1 | >31.1 |
| 145 | 415.4 | >31.5 | >26.5 | |

Where;

$T_{LIQ}$ is the possible temperature of the liquid in vessel

Sat. P is the saturation pressure at the actual temperature $\Delta H_{atm}/\Delta H_{+0.5}/\Delta H_{-0.5}$ are minimum depths under liquid level at atmospheric/+0.5 bar/−0.5 bar pressures in vessel top.

According to the present invention a continuous digester system is used that has only a single generally vertically oriented atmospheric vessel having a top and a bottom for receiving comminuted cellulose fibrous raw material and within the vessel steaming, slurrying, impregnating and digesting the fibrous material before feeding out digested fibrous material from the bottom of the vessel.

In the inlet of the vessel is any suitable metering means installed for continuously feeding the fibrous raw material into the vessel from the top thereof. The metering means could be a conventional chip meter having a rotor with pockets of a predefined volume.

The vessel also has means for establishing a first level of fibrous raw material in the vessel. This level could be monitored by any suitable conventional chip level meter available in the field.

In order to control the atmospheric pressure in the top of the vessel also the vessel has means for establishing a pressure in the top of the vessel at substantially atmospheric pressure in the range of +0.5 to −0.5 bar (g). The vessel also has means for establishing a second level of liquid in the vessel. The second level is below the first level thus creating a fibrous raw material volume in a pile above a total liquid volume in the vessel.

This pile of raw material volume provides a triple function, as condensation surfaces for any steam penetrating upwards, and a location for steaming action from underlying hotter liquids, purging air from chips, and a thrust force for the chips downward into the liquid volume.

The vessel also includes means for supplying impregnation liquids to a first end of a first upper volume of liquid in the total liquid volume held by the vessel, and also means for supplying cooking liquids to a first end of a second lower volume of liquid in the total liquid volume held by the vessel.

For heating to cooking temperature the vessel also has means for heating at least the cooking liquids in the second lower volume of liquid in the total liquid volume held by the vessel.

The first upper volume of liquid containing the impregnation zone has preferably a height of at least 17 meters, and preferably in the range of 17-40 meters, and more preferably in the range of 20-30 meters, which will enable typical cooking temperatures in the subsequent second lower volume of liquid containing the cooking zone.

The second lower volume of liquid containing the cooking zone has preferably a height of at least 30 meters, and more preferably at least 40-50 meters, which will enable sufficient retention time in the cooking zone at normal cooking temperatures, resulting in the required H-factor for successful delignification process.

The total height of the vessel, containing the impregnation and cooking zones is thus preferably at least 70 meters high, and preferably in the range of 75-90 meters, but should not result in a total height of liquid in the vessel exceeding 100 meters or a height of comminuted cellulose fibrous raw material exceeding 120 meters, as to high chip column may impede operation of the digester circulations due to compacting effects in the bottom of the digester. The total height should more preferably be 75-90 meters, but should not result in a total height of liquid in the vessel exceeding 100 meters or a height of comminuted cellulose fibrous raw material exceeding 120 meters. The required heights of liquids are controlled by controlling the net liquid flows entering and leaving the vessel in a conventional manner.

The vessel also has means for withdrawing spent cooking liquid from the end of the second lower volume of liquid. The vessel preferably also includes a final zone for cooling and washing the processed material. Finally, the vessel has means for continuously withdrawing slurry of digested fibrous raw material from adjacent the bottom of the vessel and feeding the slurry to subsequent post cooking systems.

Typically the digested fibrous raw material is sent to post cooking systems such as brown washing, screening, mechanical refining or any chemical pre-bleaching stages such as oxygen delignification, ozone bleaching or similar first pre-bleaching stages, all depending on the subsequent use of the digested pulp.

According to the present invention now described will the atmospheric vessel be the only handling vessel where the fibrous raw material is purged from air, impregnated and digested to an extent that the digested fibrous raw material is delignified and reaching a kappa number below 120.

High yield pulp typically used for liner is digested to a kappa number in the order of 60-90, but other pulps used for bleached grades of paper are typically digested to a kappa number in the order of 15-30.

In a preferred embodiment, the present invention has the means for heating the cooking liquids comprising a first liquid circulation conduit having a screen in the wall of the vessel in first end of the circulation conduit and an outlet pipe in the centre of the vessel at the second end of the circulation conduit, and a pump in the circulation conduit, wherein the liquid in the circulation conduit is passing a heater for heating the liquid circulated in the circulation conduit and wherein the first and second end of the first circulation conduit is located in the second lower volume of liquid.

In the most simplified form of the present invention all or the overwhelming part of the heating could be made to the cooking stage, and preceding stages could be heated by sending hot liquids from cooking stage in counter current flow upwards in the vessel. Either in a displacement function, where the hotter liquid is displacing the colder liquid, or using the heat in the liquids in heat exchangers.

In a further preferred embodiment of the present invention the means for supplying cooking liquids, preferably in form of white liquor, has a second liquid circulation conduit having a screen in the wall of the vessel in first end of the circulation conduit and an outlet pipe in the center of the vessel at the second end of the circulation conduit, and a pump in the circulation conduit, wherein the liquid in the circulation conduit receives fresh cooking chemicals to the liquid circulated in the circulation conduit and wherein the first and second end of the second circulation conduit are located in the second lower volume of liquid. Alternatively cooking liquids could be used such as white liquor, kraft black liquor, green liquor, or sulfite cooking liquor.

In the simplest embodiment of the present invention the first and second liquid circulation conduits used for heating and supplying cooking chemicals, could be one and the same liquid circulation conduit.

The means for heating the cooking liquids includes preferably a heater in the form of an indirect heat exchanger, where the heating medium used is steam. Indirect heating is preferred as the clean condensate obtained from any such indirect heaters could be used again in the clean steam production systems, and further dilution of cooking liquors with water is avoided.

In a yet a further preferred embodiment, the present invention has means for supplying impregnation liquids using as a liquid source at least partly a liquid withdrawn from the cooking zone in the second lower volume of liquid. Preferably a semi-spent cooking liquor is used, which still has a relatively high residual alkali content, well over 6 g/l and typically in the range of 6-12 g/l. Such semi-spent cooking liquor is also typically having a high sulfidity level which is advantageous for the impregnation process. The means for supplying impregnation liquids could also use as liquid source at least partly fresh cooking chemicals, preferably white liquor. This additional charge of fresh cooking liquors could be made to establish a sufficient neutralization of the wood acidity released from the original raw material, and establishment of sufficient level of alkali throughout the impregnation process, avoiding precipitation of lignin on the raw material if spent or semi-spent cooking liquor, i.e. black liquor, is used in impregnation.

In some vessels, depending on type of raw material and cooking process, it could also be preferable that the vessel has means for withdrawing spent impregnation liquids from the other end of the first upper volume of liquid. This reduces the level of dissolved lignin in the subsequent cooking stage, thus promoting further dissolution of lignin in the raw material.

An early withdrawal of impregnation liquid and condensate could also preferably be made at a position in the vessel close to the liquid surface and hence could a large part of the acidic condensate released from the steamed chips be withdrawn, reducing need for charging alkali for neutralization purposes. Such early withdrawal will also reduce harmful content of calcium, which metal is dissolved in acidic conditions and may cause scaling problems in the digester.

An early withdrawal of impregnation liquid at lower temperature also improves the overall heat economy as less mass volumes needs heating in subsequent stages.

One of the primary objects of the present invention is to provide for a simplified continuous digester, with a true single vessel system, having less investment costs as well as less operating costs, but still capable of producing pulp at commercial grades.

DETAILED DESCRIPTION

Instead of the conventional pre-treatment systems such as chip bins, steaming vessels, chip chutes, and high pressure transfer device as well as preceding impregnation vessel, a single atmospheric vessel 30 is provided according to the present invention.

Figure 1:
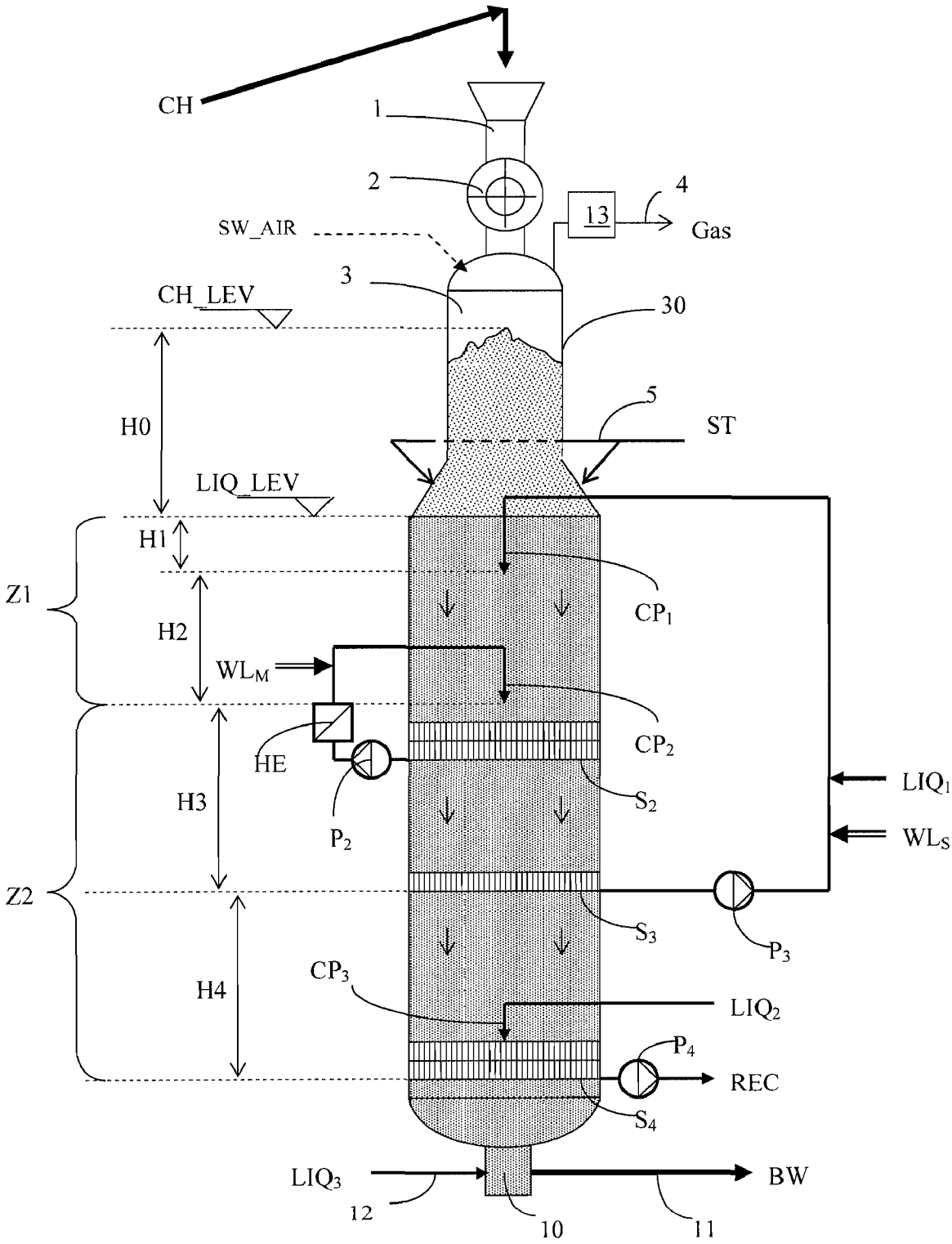
FIG. 1, shows a first embodiment of the single vessel digester system of the present invention.

The vessel, as shown in FIG. 1, is a single generally vertically oriented atmospheric vessel having a top and a bottom for receiving comminuted cellulose fibrous raw material CH. Within the vessel 30 are all the stages in digestion of the raw material performed, such as steaming, slurrying, impregnating and digesting the fibrous material before feeding out digested fibrous material from the bottom 10 of the vessel 30.

The raw material CH, preferably in the form of chips, is fed to the top of the vessel by any conventional conveyer belt system, and enters an inlet chute 1 having a conventional chip metering rotor 2 for continuously feeding the fibrous raw material into the vessel from the top thereof.

The chips that are fed into the vessel 30 are thus preferably unheated and untreated chips that normally have the same temperature as the ambient temperature.+/−.5° C.

The vessel includes conventional control for establishing a first level (CH LEV) of fibrous raw material in the vessel. This control could use a chip level meter and the in-feed of chips is controlled in order to maintain a predetermined minimum chip level (CH LEV). An alternative chip level control could use conventional gamma or radar radiation systems. In a simple control mode the speed of any conveyer belt system and the chip metering rotor 2 are increased if the chip level detected is decreasing below any set-point.

The pressure in the vessel can be adjusted as necessary through a control valve 13 arranged in a valve line 4 at the top of the vessel, possibly also in combination with control of the steam ST via input lines 5. When atmospheric pressure is to be established, this valve line can open out directly to the atmosphere. It is preferable that a pressure is established at the level of atmospheric pressure, or a slight negative pressure by the outlet 4 of magnitude −0.5 bar (−50 kPa), or a slight positive pressure of magnitude up to 0.5 bar (50 kPa). A parallel safety valve (not shown) could also preferably be implemented, such as a water seal with a 1-3 dm height of water, to ensure the establishment of the intended atmospheric pressure.

Input of a ventilating flow, SW_AIR (sweep air), can be applied at the top as necessary, which ensures the removal of any excess air or gases present. When impregnation primarily easily cooked types of wood, such as eucalyptus and other annual plants, additional steaming can be essentially avoided. The steam that penetrates the chip pile from the underlying liquid volume is in many cases fully sufficient for effective steaming. Fresh steam is thus not added to the chip pile above the fluid level established in the vessel during normal steady-sate operation. The present invention can also be applied even if coniferous and deciduous wood (softwood and hardwood) are used as raw material, giving a markedly reduced need for using fresh steam ST.

When treating primarily wood raw material that is difficult to cook, coniferous and deciduous wood, and in operational cases with extremely low temperature of the chips, (in cold seasons), the chips that lie above the fluid level established by the impregnation fluid can be heated by the addition to the impregnation vessel of external steam such that a temperature of the chips of at least 20 degrees C. and up to 80 degrees C. at the most is obtained on the chips before the chips reach the fluid level that has been established by the impregnation fluid.

A maximum liquid level LIQ_LEV is established in the vessel under the chip level CH_LEV in the vessel. Control of the level occurs by adjusting the balance between the addition of liquids to the vessel and withdrawal of liquids from the vessel by any appropriate control system. The liquid level must thus be established such that it lies under the chip level CH_LEV in the vessel. The second level of liquid (LIQ LEV) in the vessel establish a total liquid volume (Z1 & Z2) in the vessel.

The level CH_LEV of the chips above the level LIQ_LEV of the liquid, i.e, the distance marked H0 in figure, is preferably at least 2 meters and more preferably at least 5 meters when impregnating eucalyptus. In the case of wood raw material of lower density, for example, softwood, which has a density that is up to 30% lower, a corresponding increase in the height of the pile of chips over the surface of the fluid is established. This height is important in order to provide an optimal chip column movement in the vessel.

In order to establish appropriate conditions for the first impregnation stage impregnation liquids are supplied by a central pipe $CP_1$ to a first end, in FIG. 1 the upper end, of a first upper volume of liquid Z1 in the total liquid volume at a position preferably slightly below the liquid level, i.e. the distance marked H1 in figure. Here is the impregnation liquids supplied via pump $P_3$ and central pipe $CP_1$ as a mixture of semi spent cooking liquor withdrawn from screen $S_3$ in the cooking zone, and preferably with addition liquids in form of fresh cooking chemicals $WL_S$ and possible dilution liquid $LIQ_1$, the latter preferably alkaline filtrates from subsequent washing or bleaching stages. The supply of impregnation liquids thus uses as a liquid source at least partly a liquid withdrawn from the cooking zone in the second lower volume of liquid. The supply of impregnation liquids preferably also uses as liquid source at least partly fresh cooking chemicals, preferably white liquor. The impregnation stage is thus established in a concurrent impregnation stage in the upper liquid volume Z1 down to the screens $S_2$.

As the hot semi-spent cooking liquor is added to the chips ascending down from the pile, a mixed temperature is obtained lying between that of the chips and that of the semi-spent cooking liquor. The temperature established in the liquid surface is preferably close to or slightly above 100° C., such that this liquid may provide a small release of steam upwards into the ascending chip pile, where it condenses. In an alternative embodiment the central pipe $CP_1$ could end slightly above the liquid surface, such that the impregnation liquid will flash off steam at the very release into chip pile in the vessel.

The atmospheric conditions in the top of the vessel will guarantee that no excessive temperature is established in this first upper part of the impregnation zone Z1, as steam would flash upwards against the descending chip pile.

In order to establish appropriate chemical conditions for the subsequent cooking stage cooking liquids are supplied to a first end, in FIG. 1 the upper end, of a second lower volume of liquid Z2 in the total liquid volume. Here is the liquid a mixture of fresh cooking chemicals $WL_M$, added to a circulation with screen $S_2$, pump $P_2$ and a central pipe $CP_2$ ending above screen $S_2$.

In order to establish appropriate temperature conditions for the subsequent cooking stage in the second lower volume Z2 of liquid in the total liquid volume heating is performed by heater HE in the same first liquid circulation, having a screen $S_2$ in the wall of the vessel in first end of the first circulation conduit and an outlet pipe $CP_2$ in the center of the vessel at the second end of the circulation conduit, and a pump $P_2$ in the circulation conduit, wherein the liquid in the circulation conduit is passing the heater HE for heating the liquid circulated in the circulation conduit.

As shown in the table in preceding part of the description a cooking temperature of 140° C. could easily be implemented if this circulation, i.e. the outlet of central pipe $CP_2$, ends up more than 26 meters below the second liquid level if pressure in vessel top is held at 0 bar (g), i.e. at the total distance H1+H2 in the figure.

The means for heating the cooking liquids includes preferably a heater in form of an indirect heat exchanger, where the heating medium used is steam. This indirect heater is also suitable for cooling purposes in case of unplanned stops in the operations, as the indirect heater instead could use cold water instead of steam. By this forced cooling could heat merger upwards trough the chip column be prevented.

Figure 2:
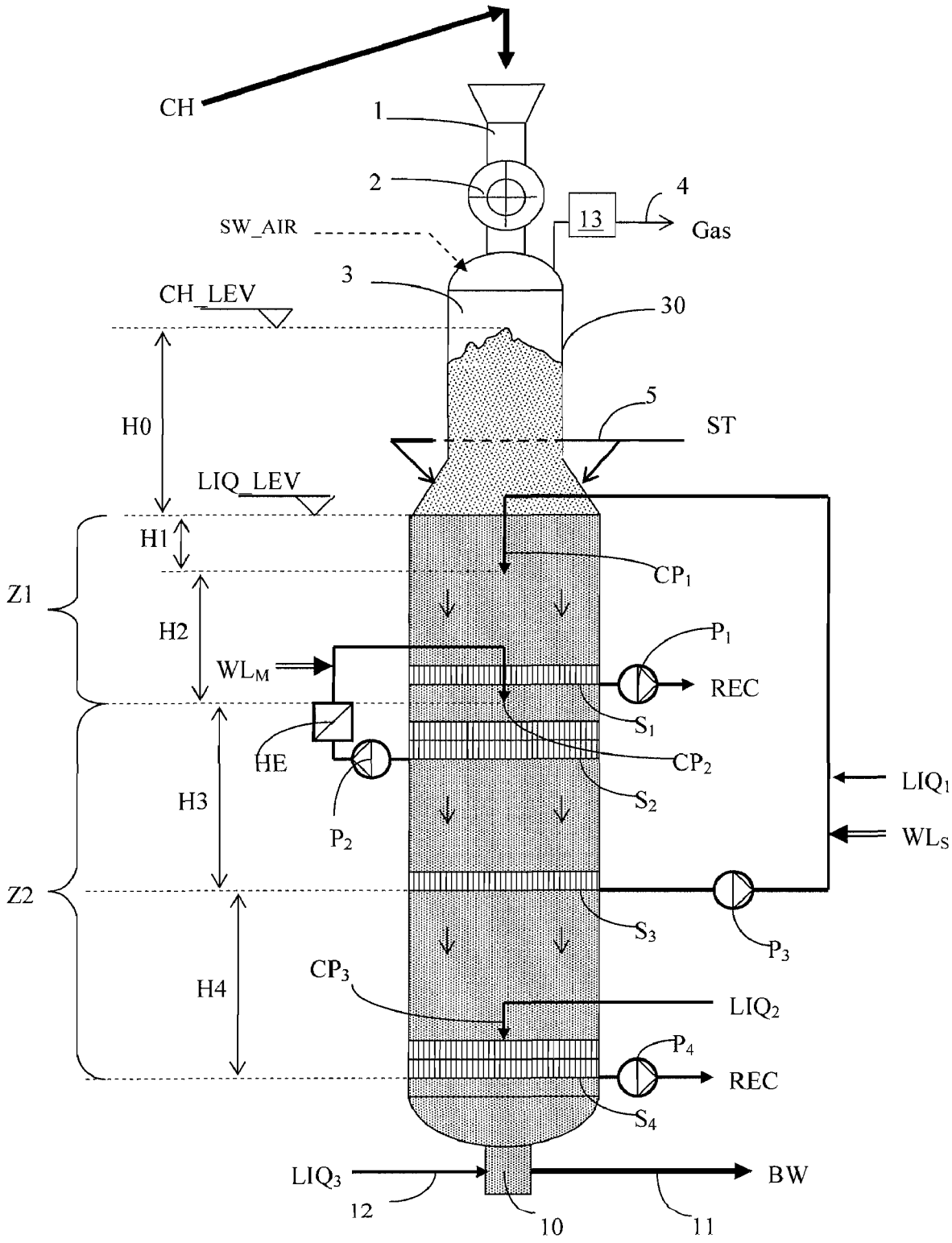
FIG. 2, shows a second embodiment of the single vessel digester system of the present invention.

The first and second end, i.e. screen $S_2$ and central pipe $CP_2$ respectively, of the first circulation conduit is located in the second lower volume of liquid Z2, and in FIG. 2 at the very start of this lower liquid volume Z2. The cooking stage is thus established as a concurrent cooking stage in the lower liquid volume Z2 down to the screens $S_3$ and $S_4$.

When the cooking stage is ended at screens $S_4$ spent cooking liquor, i.e. black liquor, is withdrawn from the other end, in FIG. 1 the lower end, of the second lower volume Z2 via screens $S_4$. The withdrawn spent cooking liquor could be sent directly or indirectly to recovery REC, preferably via recovery of the heat energy in the liquors by heat exchange against other liquids or flashing off steam in a flash tank and using the flashed steam in heat exchangers or chip steaming ST.

In FIG. 1 some wash or displacement liquid $LIQ_2$ is also added via a central pipe $CP_3$ in order to improve displacement and withdrawal of the spent cooking liquor. This kind of wash or displacement liquid $LIQ_2$ could also be added via conventional vertical and/or horizontal supply nozzles (not shown) located in the lower cupped gable of the vessel below the screens $S_4$.

Finally, in the bottom of the vessel are installed means for continuously withdrawing slurry of digested fibrous raw material from adjacent the bottom of the vessel and feeding the slurry to a subsequent post cooking systems BW via line 11. The withdrawal and feeding means is typically of a conventional outlet design, with an outlet bucket 10 and associated bottom scraper (the latter not shown) and where dilution liquid $LIQ_3$ is added to the outlet bucket in order to facilitate feed out of the digested raw material. Dilution liquid $LIQ_3$ could also in part be liquid supplied via conventional vertical and/or horizontal supply nozzles (not shown) located in the lower cupped gable of the vessel, or integrated with the bottom scraper.

By the embodiment shown in FIG. 1 the atmospheric vessel 30 is the only handling vessel where the fibrous raw material is impregnated and digested to an extent that the digested fibrous raw material is reaching a kappa number below 120.

In FIG. 2 is an alternative embodiment of the invention shown having the same features as shown in FIG. 1, but for an additional withdrawal screen $S_1$ in the lower part of the impregnation zone Z1. Here the vessel has means for withdrawing spent impregnation liquids from the other end of the first upper volume of liquid, which in FIG. 2 is the lower end of the first upper volume. This withdrawal screen is preferably located at a position in the vessel that lies above the position for addition of cooking liquid via central pipe $CP_2$, and a displacement flow of the spent impregnation liquid towards screen $S_1$ is established, in the lower part of the fluid-filled zone Z1 in the vessel 30.

Figure 3:
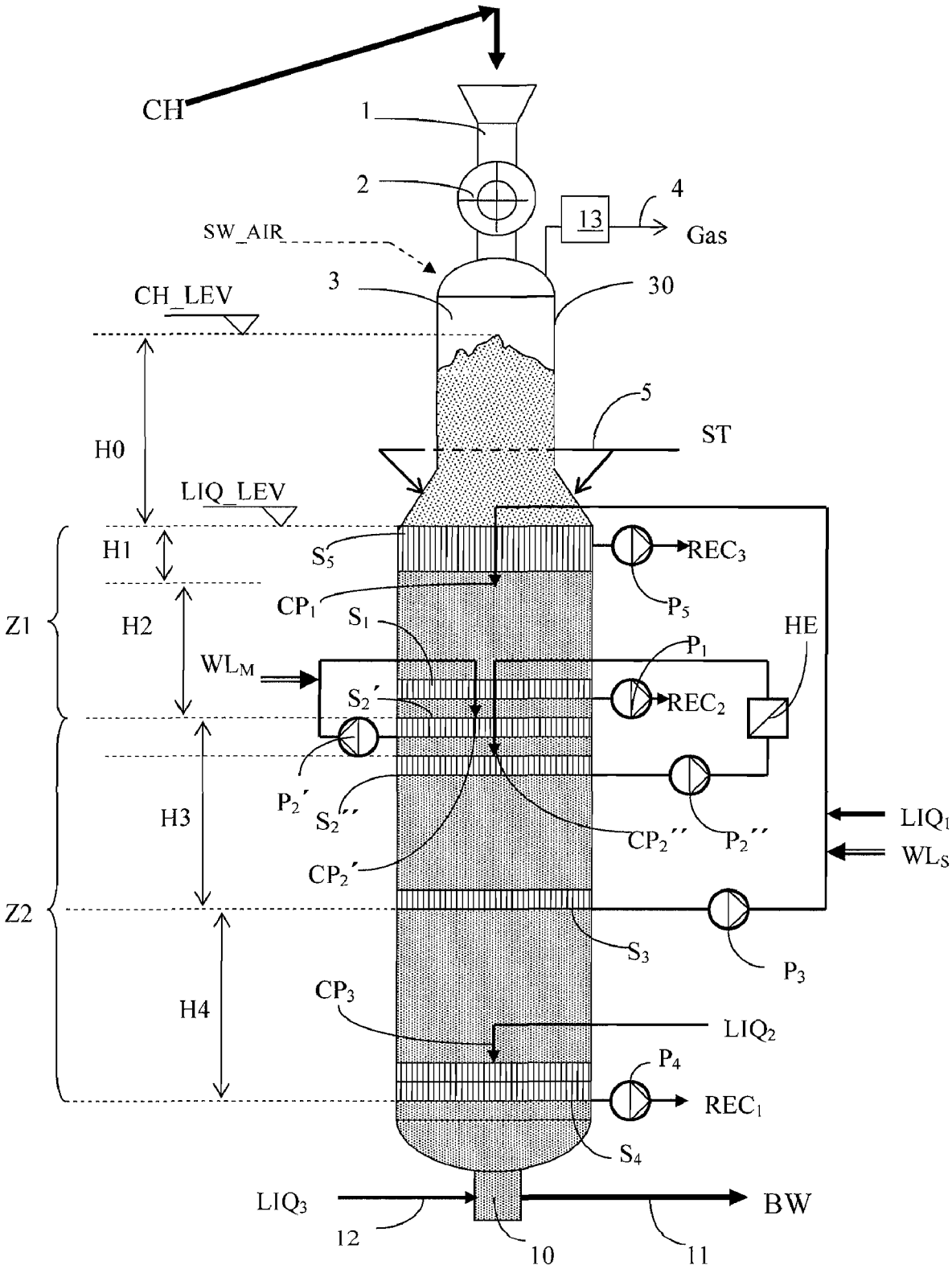
FIG. 3 shows a third embodiment of the single vessel digester system of the present invention.

In FIG. 3 yet another alternative embodiment of the present invention is shown that have the same features as shown in FIG. 1, but for;

separate liquid circulations for adding cooking chemicals, i.e. $S_2'$—$P_2'$—$CP_2'$;

separate liquid circulations for heating, i.e. $S_2''$—$P_2''$—HE-$CP_2''$; and early withdrawal of impregnation liquid and condensate via screen $S_5$ and pump P5.

In FIG. 3 the means for supplying cooking liquids, preferably in form of white liquor, has a second liquid circulation conduit having a screen $S_2'$ in the wall of the vessel in first end of the circulation conduit and an outlet pipe $CP_2'$ in the center of the vessel at the second end of the circulation conduit, and a pump $P_2'$ in the circulation conduit. The liquid in the circulation conduit is passing a mixer for adding fresh cooking chemicals $WL_M$ to the liquid circulated in the circulation conduit and wherein the first and second end of the second circulation conduit is located in the second lower volume of liquid Z2, which in FIG. 3 is the upper end of the lower volume of liquid.

The early withdrawal of impregnation liquid and condensate is made via screen $S_5$ located close to the liquid surface and pump P5. By this location of the screen $S_5$ could a large part of the acidic condensate released from the steamed chips be withdrawn, reducing need for charging alkali only for neutralization purposes.

Comparative Examples

Figure 4:
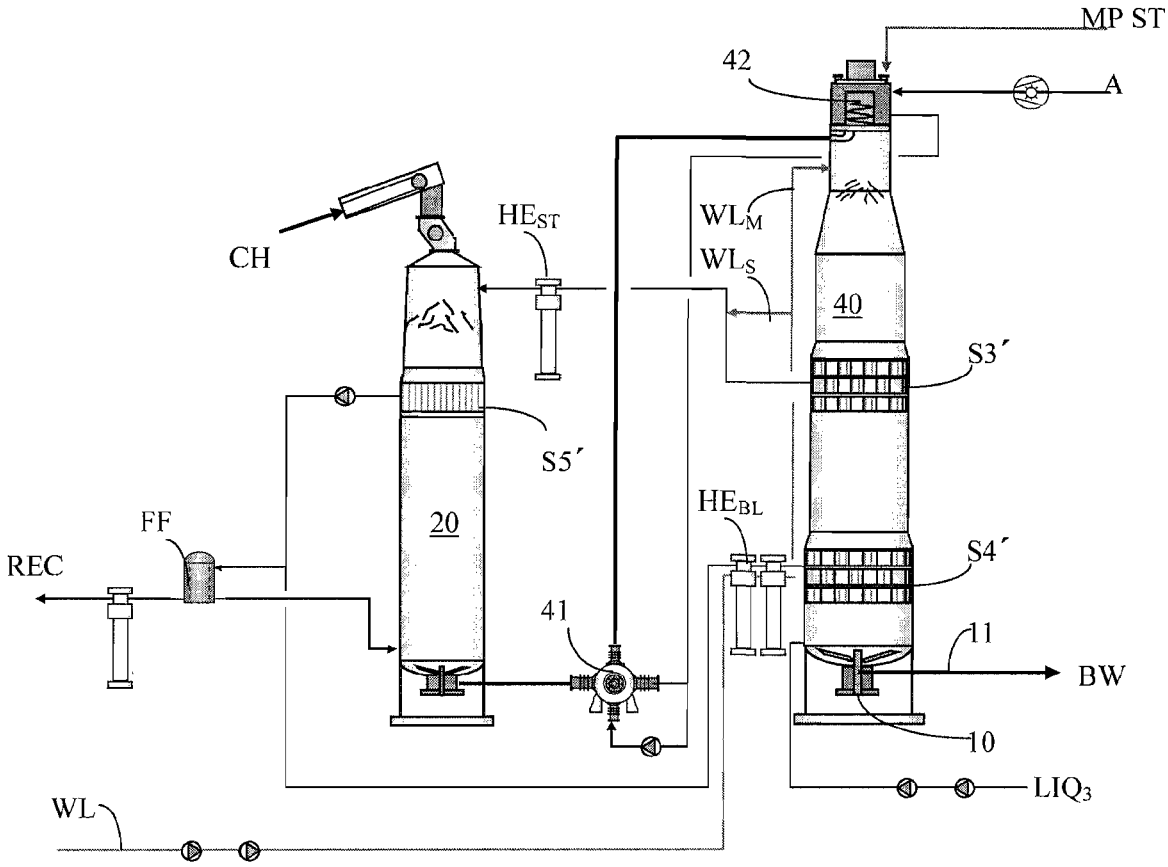
FIG.4 PRIOR ART
FIG. 4 shows a prior art digester system with an IMPBIN™ ahead of the digester, used for comparison.
Figure 5:
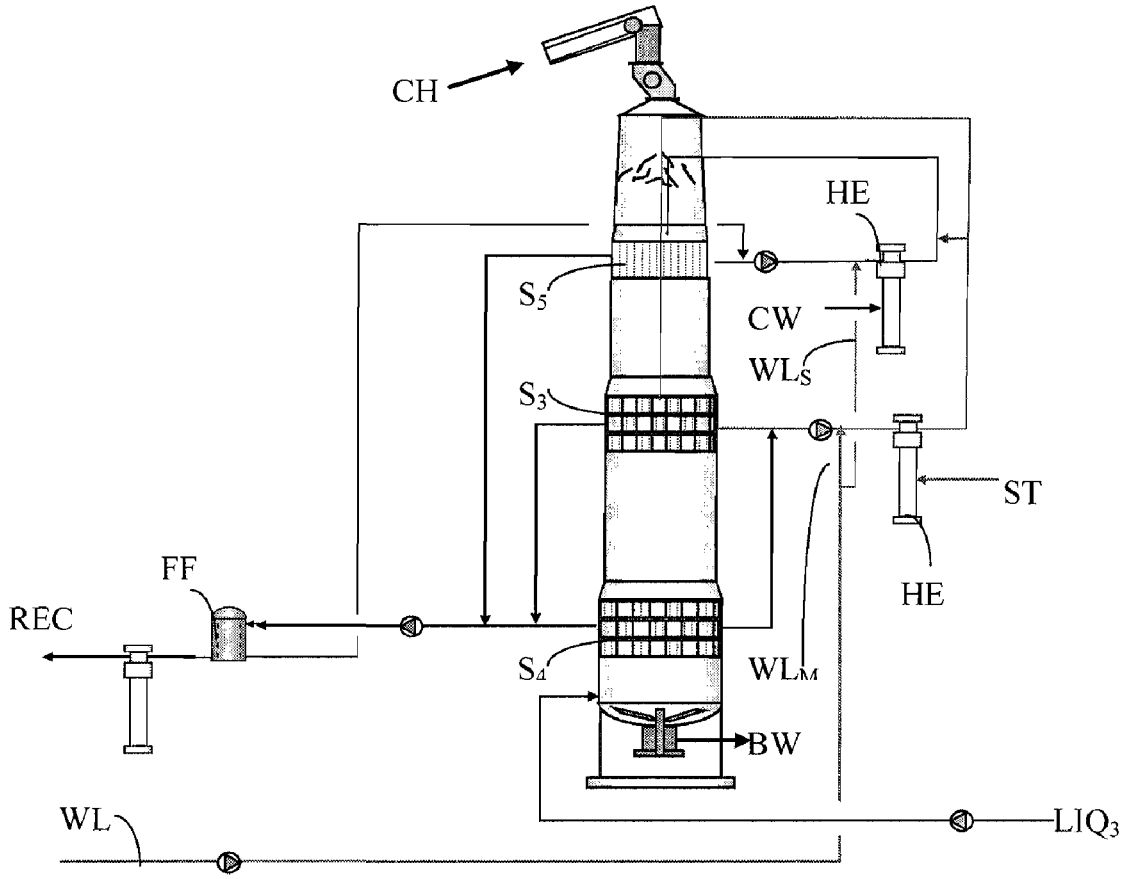
FIG. 5 shows an embodiment of the present invention replacing the system shown in FIG. 4.

In FIG. 4 a state of the art digester system is shown with an IMPBIN™ located ahead of the digester. In FIG. 5 a comparative example of the present invention is shown applied for the same process. In both examples shown in FIGS. 4 and 5 the screens with similar functions are given similar reference numbers, such as $S_5$ for the early withdrawal screen close to the liquid surface, $S_3$ for the withdrawal of semi-spent cooking liquor, and $S_4$ for the final spent cooking liquor drawn from the digester and subsequently sent to recovery, together with liquor from the early withdrawal from $S_5$. The figures also show a fiber filter FF in the stream of spent liquors, which sifts out fiber residues in the liquor streams and circulates these fiber residues back to appropriate positions in the digester system. In FIG. 4 is the conventional high-pressure sluice feeder 41 is also in the transfer system from the low pressure part, i.e. the IMPBIN 20, and the digester.

The system shown in FIG. 4 is a typical implementation of the Compact Cooking™ G2 Process for cooking Eucalyptus (Hardwood) pulp, having a production capacity of 1500 ADMT/day.

The IMPBIN™ 20 has a diameter of 5.2 meters and a height of 40.5 meters, reaching a total volume of 550 $m^3$. The digester 40 has a diameter of 7.4 meters and a height of 49 meters, reaching a total volume of 1950 $m^3$. The total volume in the system thus, i.e. IMPBIN™ 20 plus digester 40, amounts to 2500 $m^3$.

The total installed available power amounts to 1950 kW, and the power consumption per ton of pulp amounts to 21.8 kW/ADT. This system needs a total heat exchanger area of 600 $m^2$ and the MP (Medium Pressure) steam consumption amounts to 400 kg/ADT. The process needs a total alkali charge of 18% EA.

The system shown in FIG. 5 is an implementation of the present invention using the principles of the Compact Cooking™ G2 Process for cooking Eucalyptus (Hardwood) pulp and has the same production capacity of 1500 ADMT/day at a total alkali charge of 18% EA. The single vessel system according to the present invention has a digester having a diameter of 7.4 meters and a height of 82 meters, reaching a total volume of 2700 $m^3$.

However, the total installed available power amounts to only 1400 kW, and the power consumption per ton of pulp amounts to only 15.7 kW/ADT, which corresponds to savings in the order of 28%. The large part of the savings is obtained from lack of pumps for pressurizing and feeding the impregnated slurry to the digester top (i.e. sluice feeder and/or pumps), lack of any top separator and lack of any bottom scraper in IMPBIN. The only increase in power consumption is the extended height of operation of the existing chip conveyer, which additional power requirement, is negligible in comparison to the power consumption of deleted machines. This system needs a total heat exchanger area of 650 $m^2$ and the MP (Medium Pressure) steam consumption amounts to the same order of 400 kg/ADT.

The difference in heating in the systems shown is that the cooking temperature in the system shown in FIG. 4 is established largely in part by direct steam heating in digester top, resulting in that clean steam condensate is diluting the cooking chemicals and putting extra capacity requirement in the evaporation process. In the system shown in FIG. 5 cooking temperature is reached only by using liquor circulations and indirect steam heating, which enables a recovery of the clean steam condensate, thus decreasing net thermal energy usage. In both systems it is possible to mix different liquors, i.e. total liquor flows or parts thereof, to reach any desired temperature profiling and heat economy.

It will thus be seen that according to the present invention a simplified digester system is provided which would require far less investment costs and lower operation costs. The operating costs are of ever increasing interest in order to save energy and obtain an environmental friendly system.

The embodiments shown are principle designs utilizing the inventive concept of the present invention, and it will be apparent to those skilled in digester operations that many modifications can be made within the scope of the present invention.

As examples of modifications are changes of the impregnation or digester zones or both to counter current operation, in parts or the entire zone. More circulations could also be implemented in order to modify the concentration of cooking chemicals or amount of dissolved lignin or total dissolved organic material or dissolved amount of metals such as calcium, which need for additional circulations is depending upon the type of cellulose fibrous raw material fed to the vessel.

While the present invention has been described in accordance with preferred compositions and embodiments, it is to be understood that certain substitutions and alterations may be made thereto without departing from the spirit and scope of the following claims.

I claim:

1. A method for producing a digested raw material, comprising:

providing a single vertically oriented atmospheric vessel having a top and a bottom, an inlet chute disposed on top of the vessel;

continuously feeding cellulose fibrous raw material into the inlet chute;

establishing a pressure in a range of +0.5 bar and −0.5 bar at the top of the vessel in an atmospheric gas phase;

establishing a first level (CH LEV) of the cellulose fibrous raw material in the vessel;

establishing a second level (LIQ LEV) of a liquid disposed below the first level by adding liquid into the vessel;

establishing a concurrent impregnation zone disposed immediately below the second level;

in a slurrying zone below the atmospheric gas phase, slurrying the cellulose fibrous raw material;

in the concurrent impregnation zone below the second level (LIQ LEV) of the vessel, impregnating the cellulose fibrous material with an impregnation liquid;

providing a first screen in the vessel disposed below the concurrent impregnation zone and a first concurrent cooking zone disposed below the first screen;

heating a cooking liquor;

adding the heated cooking liquor to the first concurrent cooking zone disposed below the concurrent impregnation zone;

cooking the cellulose fibrous raw material in the first concurrent cooking zone until a slurry of a digested raw material having a kappa number below 100 is formed;

providing a recirculation conduit extending from the first screen;

adding fresh cooking liquor to the recirculation conduit; and continuously withdrawing the slurry of the digested raw material from the vessel.

2. The method according to claim 1 wherein the method further comprises establishing a temperature in a liquid surface at the second level (LIQ LEV), the temperature being close to or slightly above 100° C.

3. The method according to claim 2 wherein the method further comprises releasing steam upwardly through a chip pile disposed below the first level (CH LEV).

4. The method according to claim 3 wherein the method further comprises the steam condensing in the chip pile.

5. The method according to claim 2 wherein the method further comprises providing a central pipe CP1 terminating above the liquid surface.

6. The method according to claim 5 wherein the method further comprises the impregnation fluid flashing off steam into the chip pile.

7. The method according to claim 1 wherein the method further comprises establishing a recirculation circuit extending from the first screen, disposed below the impregnation zone, to a bottom of the concurrent impregnation zone.

8. The method according to claim 7 wherein the method further comprises adding fresh cooking liquor to the recirculation circuit.

9. The method according to claim 7 wherein the method further comprises using the first screen to withdraw a spent liquor from the vessel and the recirculation circuit conveying the spent liquor to the impregnation zone.

10. The method according to claim 3 wherein the method further comprises the atmospheric gas phase guaranteeing that no excessive temperature is established in a first upper part of the impregnation zone as steam flashes upwardly against the chip pile.

11. The method according to claim 1 wherein the method further comprises providing a second screen disposed below the first concurrent cooking zone of the vessel and withdrawing the impregnation liquid from the second screen.

* * * * *